US009113772B1

(12) United States Patent
Morad et al.

(10) Patent No.: US 9,113,772 B1
(45) **Date of Patent: *Aug. 25, 2015**

(54) HAND OPERATED SWEEPING MOP WITH SHOTGUN MECHANISM TO RELEASE A USED CLEANING CLOTH

(71) Applicants: Fred I. Morad, Toluca Lake, CA (US); William P. Camp, Jr., Vanlue, OH (US)

(72) Inventors: Fred I. Morad, Toluca Lake, CA (US); William P. Camp, Jr., Vanlue, OH (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/195,742

(22) Filed: Mar. 3, 2014

Related U.S. Application Data

(62) Division of application No. 14/030,107, filed on Sep. 18, 2013, now Pat. No. 8,701,238.

(51) Int. Cl.
*A47L 13/20* (2006.01)
*A47L 13/256* (2006.01)
*A47L 13/255* (2006.01)

(52) U.S. Cl.
CPC ..... *A47L 13/256* (2013.01); *A47L 13/255* (2013.01)

(58) Field of Classification Search
CPC ..... A47L 13/255; A47L 13/256
USPC ..... 15/147.1, 228, 231, 244.1
See application file for complete search history.

(56) References Cited

U.S. PATENT DOCUMENTS

| | | | | |
|---|---|---|---|---|
| 4,634,357 | A * | 1/1987 | Brewer et al. | 425/36 |
| 5,323,507 | A * | 6/1994 | Tosato | 15/231 |
| 7,496,985 | B1 * | 3/2009 | Morad | 15/228 |
| 7,908,701 | B1 * | 3/2011 | Aiyar | 15/228 |
| 8,214,963 | B2 * | 7/2012 | Yu | 15/119.1 |
| 8,272,093 | B2 * | 9/2012 | Wu | 15/229.1 |
| 8,296,895 | B2 * | 10/2012 | Michelson et al. | 15/244.4 |
| 8,312,587 | B2 * | 11/2012 | Chen | 15/228 |
| 2008/0016634 | A1 * | 1/2008 | Vosbikian et al. | 15/104.93 |
| 2010/0101407 | A1 * | 4/2010 | Lynn et al. | 91/505 |
| 2011/0167583 | A1 * | 7/2011 | Weaver et al. | 15/231 |
| 2012/0180236 | A1 * | 7/2012 | Michelson et al. | 15/119.2 |
| 2012/0192373 | A1 * | 8/2012 | Chen | 15/228 |

* cited by examiner

*Primary Examiner* — Monica Carter
*Assistant Examiner* — Michael Jennings
(74) *Attorney, Agent, or Firm* — Thomas I. Rozsa

(57) ABSTRACT

A hand operated sweeping mop applicator with a unique disposable cloth retaining assembly where the cloth is retained by cloth retaining members attached to the bottom of a top plate which extend perpendicularly away from a bottom of the top plate and extend through aligned openings in a bottom plate to retain a cleaning cloth against a bottom surface of the bottom plate. Separation force members such as force springs are sandwiched between the bottom of the top plate and the top of the bottom plate and retained in a compressed state buy a force from a shotgun closing member.

2 Claims, 13 Drawing Sheets

HAND OPERATED SWEEPING MOP WITH SHOTGUN MECHANISM TO RELEASE A USED CLEANING CLOTH

This patent application is a divisional of application Ser. No. 14/030,107 filed on Sep. 18, 2013, now pending.

BACKGROUND OF THE INVENTION

1. Field of the Invention

The present invention relates to the field of hand operated sweeping mops which retain a disposable cleaning cloth.

2. Description of the Prior Art

In general, various types of hand operated sweeping mops are known in the prior art.

The hand operated sweeping mops include a generally rectangular shaped main body having an upper or top surface which includes a rotatable yolk attached to a collar having an opening which receives an elongated handle which is grasped by a user when operating the sweeping mop.

The main body also has a flat lower or bottom surface with a disposable cleaning cloth affixed to the sweeping mop applicator so that the disposable cleaning cloth is positioned under the lower or bottom surface and is retained onto the main body by various different retaining members.

In one retaining member configuration, the lower surface of the main body has hook and loop fasteners affixed to the lower surface and the disposable cleaning cloth is retained onto the lower surface of the main body by the hook and loop fasteners. In another configuration, the disposable cleaning cloth is retained onto the main body by several attachment members usually positioned on the upper surface on opposite sides of the yolk so that the disposable cleaning cloth is wrapped around the outer circumference of the main body and then attached by the attachment members to the sweeping mop.

One common problem with all prior art hand operated sweeping mop applicators also called flat mop applicators is that when the disposable cloth is very dirty after cleaning operations, the user must use at least one of his/her hands to grasp the dirty cleaning cloth and remove it from its attachment member on the sweeping mop applicator also called a flat mop applicator. Therefore, the user is exposed to the filth and dirt on the disposable cleaning cloth. There is a significant need for an improved apparatus which eliminates the requirement for a user to grasp the dirty cleaning cloth by hand when removing it from the sweeping mop applicator or flat mop applicator and replacing it.

SUMMARY OF THE INVENTION

The present invention is a hand operated sweeping mop applicator with a unique disposable cloth retaining assembly where the cloth is retained by cloth retaining members attached to the bottom of a top plate which extend perpendicularly away from a bottom of the top plate and extend through aligned openings in a bottom plate to retain a cleaning cloth against a bottom surface of the bottom plate. Closing force members such as force springs are sandwiched between the bottom of the top plate and the top of the bottom plate and retained in a compressed state to retain the top plate and bottom plate together.

The shotgun plate separation member includes an engaging assembly having an open cylindrical member by which it is rotatably retained between two yoke members on the top surface of the top plate to enable the handle to rotate back and forth in a given direction. The engaging assembly includes an intermediate "H" shaped connector rotatably connected to the open cylindrical member so that the handle can also rotate in a direction perpendicular to the direction of rotation of the open cylindrical member rotatably retained between the two yoke members. The engagement assembly also includes a top cylindrical hollow collar having a transverse opening in the cylindrical wall and a top rim.

The shotgun further includes an elongated cylindrical metal shaft having a transverse opening adjacent its lower proximal end, the upper end of the elongated cylindrical metal shaft is covered by a covering member having a multiplicity of spaced apart longitudinal ribs and terminating in a stop ring on the elongated cylindrical metal shaft to prevent axial movement on the covering member beyond the stop ring. A lower housing has a hollow interior with an interior surface having a multiplicity of interior longitudinal shafts which correspond to the exterior ribs on the covering member so that when the lower exterior housing is placed over the elongated cylindrical metal shaft and a portion of the covering member, the aligned ribs and shafts prevent rotation of the exterior housing about the elongated cylindrical metal shaft and covering member. A retaining force spring surrounds a portion of the elongated cylindrical metal shaft and is press fit retained between a distal end of the covering member and the upper rim of the collar of the engagement member. A C-clip inserted through aligned transverse openings in the elongated cylindrical metal shaft and collar of the engagement member retains the engagement member to the elongated cylindrical metal shaft with the retaining force spring retained in a compressed state. The lower housing has a multiplicity of feet which respectively receive posts which extend perpendicularly from the bottom plate and through the top plate. In its at rest condition, the retaining force spring causes the lower housing to be axially pulled away from the top and bottom plates until axial movement is restrained by the stop ring The lower outer housing is separated from the stop ring by a given distance. In its at rest condition, the lower housing member is pulled upwardly or axially on the covering member by the retaining force spring until it reaches the stop ring. The upward pulling force causes the aligned feet in the lower housing to be separated from the four aligned posts on the bottom plate which respectively extend through respective openings on the top plate. The retaining springs between the top plate and the bottom plate cause the two plates to be retained together. In operation, a downward pushing force on the lower housing of the shotgun assembly causes the four aligned feet to be respectively aligned with the four posts so that the pushing force overcomes the retaining force of the retaining spring in the shotgun assembly and pushes downwardly on the bottom plate to also overcome the retaining force of the internal force spring between the top plate and bottom plate. As a result, the retaining force is overcome and the pushing force from the feet of the lower housing on the aligned posts cause the bottom plate to be separated from the top which disengages the cloth retaining members on the bottom surface of the top plate from the cleaning cloth and enables the cleaning cloth to fall away from the bottom surface of the bottom plate without having to be touched with a person's hand.

When the pushing force on the lower housing is released, the interior retaining spring forces the lower housing axially away from the top plate until movement is restrained by the stop ring so that the four feet of the lower housing are respectively disengaged from a respective post to cause the top and bottom plates to be compressed together by the retaining force springs between the two plates so that a new cloth can be retained against the bottom of the bottom plate by the retaining member extending from the bottom of the top plate through aligned openings in the bottom plate to come in contact with and retain the cleaning cloth. The downward pushing force on the lower exterior housing and its automatic return motion from the upward return force of the internal retaining force spring when the pushing force on the lower housing is released resembles a shotgun.

It is an object of the present invention to provide a mechanism on a hand operated sweeping mop applicator which retains a cleaning cloth in a manner which enables the cleaning cloth after it has been used and becomes dirty to be released and fall into a trash receptacle without the necessity of a user's hand touching the dirty cleaning cloth.

It is also an object of the present invention to provide a mechanism for a hand operated sweeping mop applicator which includes a pushing force to push downwardly on a plate against which a cloth is retained to force a downward motion to separate an upper plate having cloth retaining means from the lower plate against which the cloth is retained by the cloth releasing means in the upper plate to enable the dirty cleaning cloth to be separated from the cloth retaining means so that when the connection is released, the cleaning cloth is released without requiring a human hand to touch a dirty cleaning cloth.

It is an additional object of the present invention to provide a mechanism which limits the downward travel of a cloth releasing plate so that it will not fall away from the main body of the sweeping mop applicator.

It is a further object of the present invention to provide a shotgun mechanism to permit the plates of the applicator to remain together and then by a pushing force on the shotgun mechanism causes a separation of the two plates to release the retaining force from a top plate on a cleaning cloth to enable the cleaning cloth top to be released without being touched by a hand.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claim.

Figure 3:
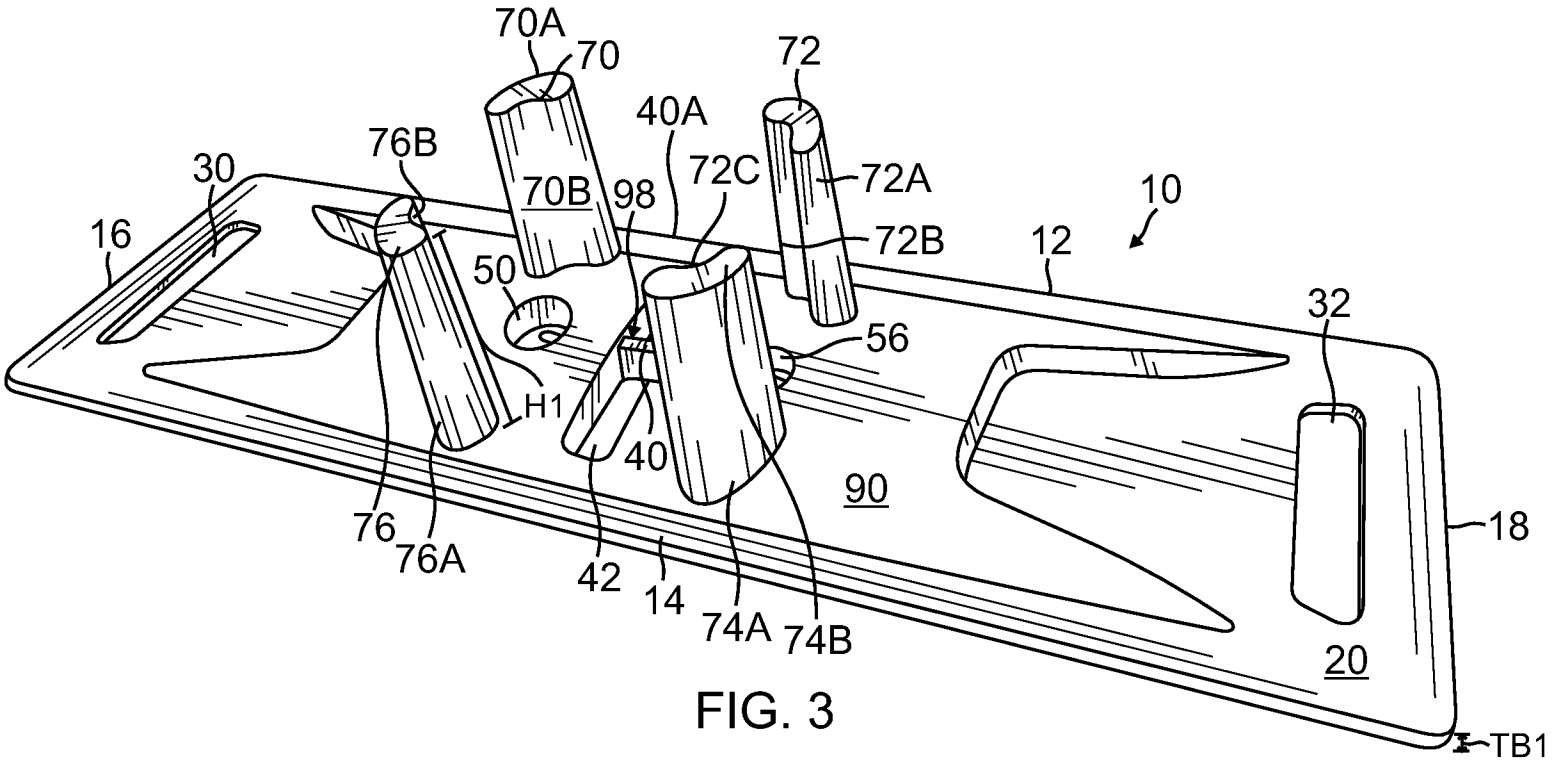
FIG. 3 is a top perspective view of the bottom plate of the present invention.
Figure 4:
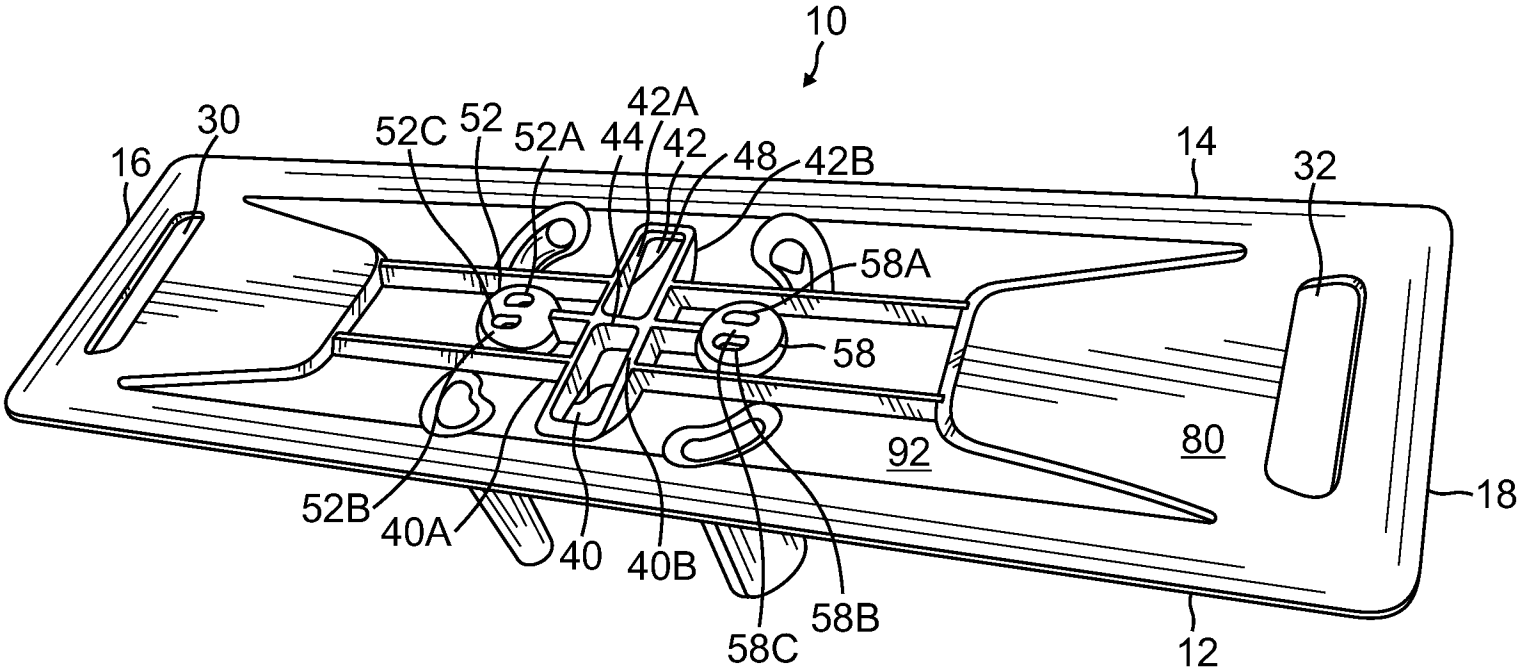
FIG. 4 is a bottom perspective view of the bottom plate of the present invention.

Referring first to FIGS. 3 and 4, there are respectively illustrated a top perspective view and a bottom perspective view of the bottom plate 10 of present invention hand operated sweeping mop with shotgun mechanism to release a used cleaning cloth. The bottom plate 10 is generally rectangular in shape having a first lengthwise sidewall 12, a parallel oppositely disposed second lengthwise sidewall 14, a first transverse wall 16 and a parallel oppositely disposed second transverse wall 18. The bottom plate 10 has a given thickness "TBP1" from its top surface 20 to its bottom surface 80.

A first transverse opening 30 is adjacent to the first transverse wall 16 and extends through the thickness "TB1" from top surface 20 to the bottom surface 80. A second transverse opening 32 is parallel to the first transverse opening 30. The second transverse opening 32 is adjacent second transverse wall 18 and extends through the thickness "TB1" from top surface 20 to bottom surface 80.

A first center transverse opening 40 extends from adjacent the first lengthwise sidewall 12 to adjacent a center point 98 of the bottom plate 10 and extends through the thickness "TB1" from top surface 20 to the bottom surface 80. An aligned center transverse opening 42 extends from adjacent the second lengthwise sidewall 14 to adjacent the center point 98 of the bottom plate 10 and extends through the thickness"TH1" from top surface 20 to bottom surface 80. A center wall 44 separates first center transverse opening 40 from second center transverse opening 42, and extends through the entire thickness "TB1" from top surface 20 to bottom surface 80. A first offset opening 50 extends from adjacent a first side 40A and 42A of center transverse openings 40 and 42 from top surface 20 and partially into thickness "TB1". A first spring retaining member 52 extends from an aligned location in bottom plate 10 from bottom surface 80 into first offset opening 50 and has a pair of openings 52A and 52B separated by a center wall 52C to retain an end of a first retaining spring. A second offset opening 56 extends from adjacent a second side 40B and 42B of center transverse openings 40 and 42 from top surface 20 and partially into thickness "TB1". A second spring retaining member 58 extends from an aligned location in bottom plate 10 from bottom surface 80 into second offset opening 56 and has a pair of openings 58A and 58B separated by a center wall 58C to retain an end of a second retaining spring.

Four posts 70, 72, 74 and 76 are positioned 90 degrees apart in a circular configuration. Spaced apart posts 70 are 72 are adjacent first lengthwise sidewall 12 and are respectively to the left of first offset opening 50 and to the right of second offset opening 52. Spaced apart posts 74 and 76 are adjacent second lengthwise sidewall 14 and are respectively to the right of second offset opening 52 and to the left of first offset opening 50. Each post 70, 72, 74 and 76 extends perpendicularly to the top surface 20 for a given height "H1" which by way of example can be one (1) inch and are respectively embedded into the bottom plate and extends through bottom plate thickness "TB1" from top surface 20 to bottom surface 80. By way of example, each post 70, 72, 74 and 76 can be arcuate with a convex exterior surface 70A, 72A, 74A, and 76A and a concave interior surface 70B, 72B, 7B and 76B.

A first ornamental design 90 is positioned on top surface 20 so that it becomes a part of the top surface and posts 70, 72, 74 and 76 and first and second offset openings 50 and 56 and first and second transverse openings 40 and 42 all extend through the first ornamental design 90. A second ornamental design 92 is positioned on bottom surface 80 so that it becomes a part of the bottom surface and posts 70, 72, 74 and 76 and corresponding items extend through the ornamental design 92. First and second retaining spring members 52 and 58 and first and second transverse openings 40 and 42 all extend through second ornamental design 92.

Figure 5:
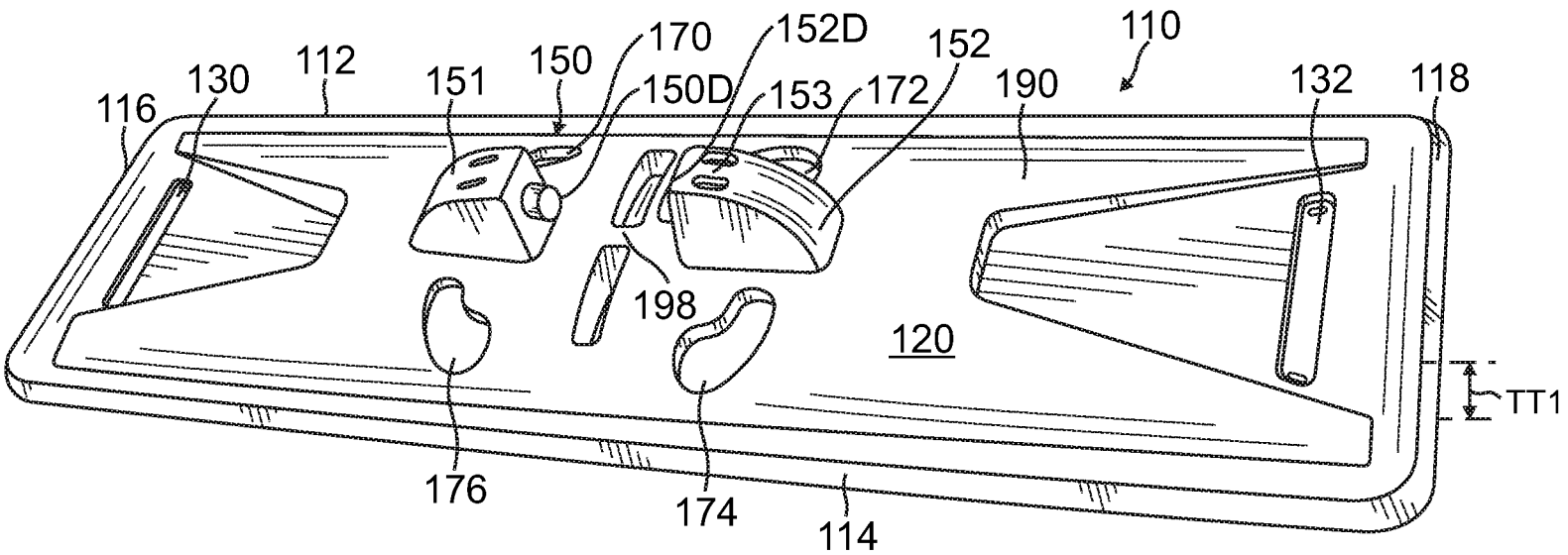
FIG. 5 is a top perspective view of the top plate of the present invention.
Figure 6:
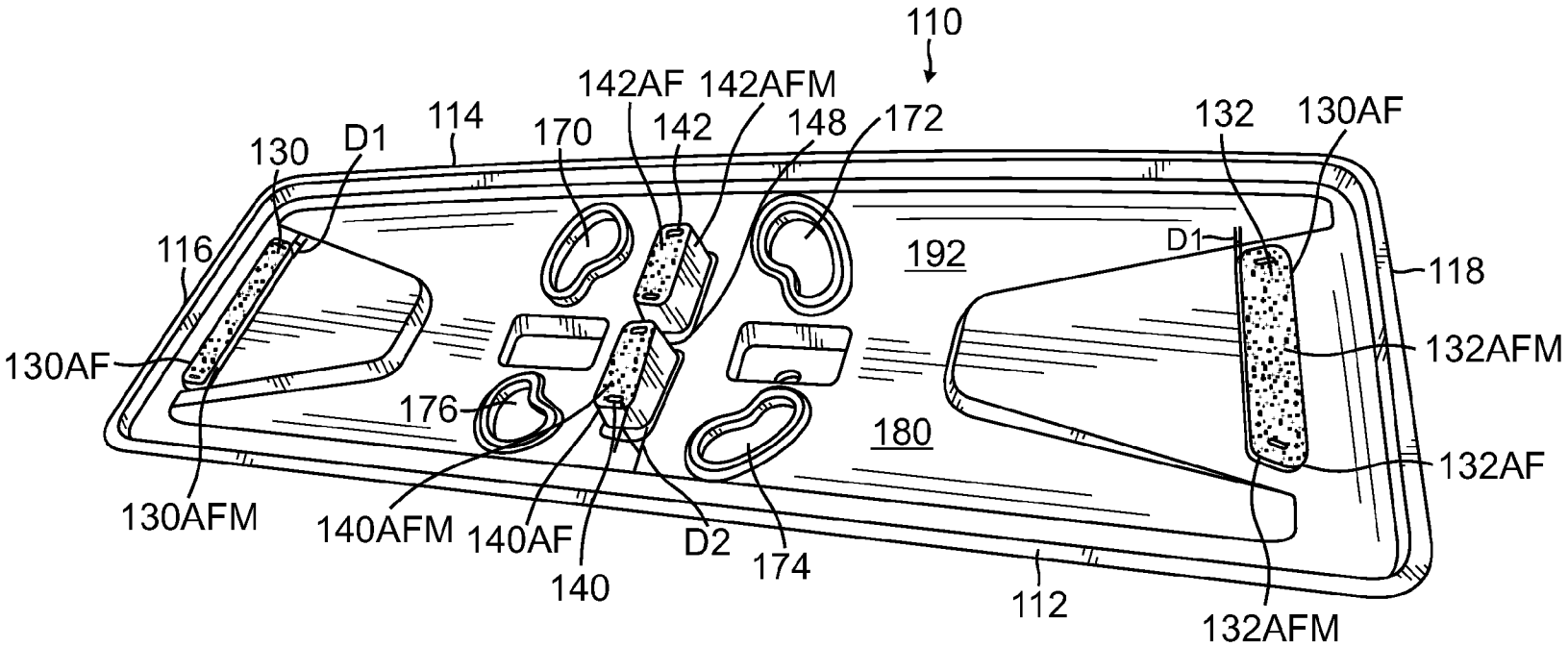
FIG. 6 is a bottom perspective view of the top plate of the present invention.

Referring to FIGS. 5 and 6, the are respectively illustrated a top perspective view and a bottom perspective view of the top plate 110 of the present invention hand operated sweeping mop with shotgun mechanism to release a used cleaning cloth. The top plate 110 is generally rectangular in shape and is preferably the same size as the bottom plate 10. The top plate 110 has a first lengthwise sidewall 112, a parallel oppositely disposed second lengthwise sidewall 114, a first transverse wall 116 and a parallel oppositely disposed second transverse wall 118. The top plate 110 has a given thickness"TT1" from its top surface 120 to its bottom surface 180.

A first transverse affixation member 130 is adjacent the first transverse wall 116 and extends for a distance "D1" perpendicular to the bottom surface 180, and terminates in a bottom affixation surface 130AF which retains an affixation member 130AFM which preferably is a hook member of a hook and loop fastener. A second transverse affixation member 132 is adjacent the second transverse wall 118 and extends for the distance "D1" perpendicular to the bottom surface 180, and terminates in a bottom affixation surface 132AF which retains an affixation member 132AFM which preferably is a hook member of a hook and loop fastener.

A first yoke retaining member 150 is positioned on the top surface 120 to one side of the location where the first and second transverse affixation members 140 and 142 are located on the bottom surface 180. The first yoke retaining member 150 is affixed to and extends perpendicular to the top surface 120 and supports an interior dowel 150D which extends toward center point 198 of top member 110. A second yoke retaining member 152 is positioned on the top surface 120 at an opposite side of the location where the first and second transverse affixation members 140 and 142 are located on the bottom surface 180. The second yoke retaining member 152 is affixed to and extends perpendicular to the top surface 120 and supports an interior dowel member 152D. Yoke members are parallel and aligned with each other and are affixed to top surface 120. The dowels 150D and 162D are aligned with each other.

A first central transverse affixation member 140 extends from adjacent the first lengthwise sidewall 112 adjacent to a center point 198 of the top plate 110 and extends perpendicular to the bottom surface 180 by a distance "D2, and terminates in a bottom affixation surface 140AF which retains a first central affixation member 140AFM which preferably is a hook member of a hook and loop fastener. An aligned second central transverse affixation member 142 extends from adjacent the second lengthwise sidewall 114 adjacent to the center point 198 of the top plate 110 and extends perpendicular to the bottom surface 180 by a distance "D2", and terminates in a bottom affixation surface 142AF which retains second central affixation member 142AFM which preferably is a hook member of a hook and loop fastener. The transverse affixation members 140 and 142 are spaced apart by a distance "D3".

Four openings 170, 172, 174 and 176 are positioned 90 degrees apart in a circular configuration. Spaced apart openings 170 and 172 are adjacent first lengthwise sidewall 112 and spaced apart openings are adjacent second lengthwise sidewall 114. The openings 170, 172, 174 and 176 extend through the entire thickness "TT1" of top plate 110 and extend from top surface 120 to bottom surface 180. Respective spaced apart openings 170, 172, 174 and 176 match the shape of posts 70, 72, 74 and 76. The opening 170 172, 174 and 176 can be arcuate with a convex exterior outer surface and a concave interior inner surface.

A third ornamental design 190 is positioned on top surface 120 so that it becomes part of top surface 120 and yoke retaining members 150 and 152 can rest on ornamental design and affixed to third ornamental design 190. Openings 170, 172, 174 and 176 also extend through the third ornamental design 190.

The bottom surface 180 has a fourth ornamental design 192 and the affixation members 130, 132, 140 and 142 can extend through and perpendicularly away from the ornamental design 192. Openings 170, 172, 174 and 176 can also extend through the ornamental design 192.

Figure 7:
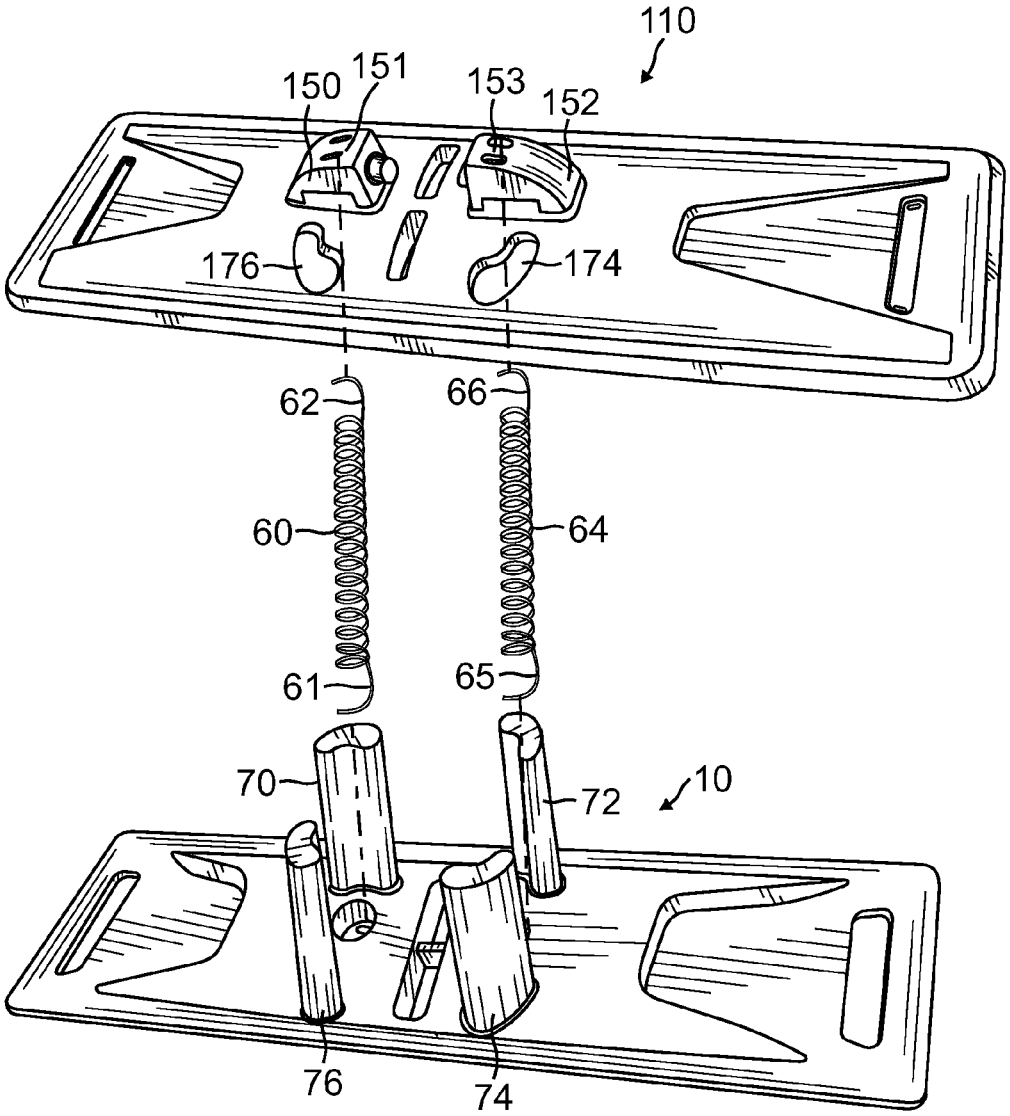
FIG. 7 is a top exploded perspective view of the top plate, bottom plate and plate retaining force spring members between the top plate and the bottom plate.
Figure 8:
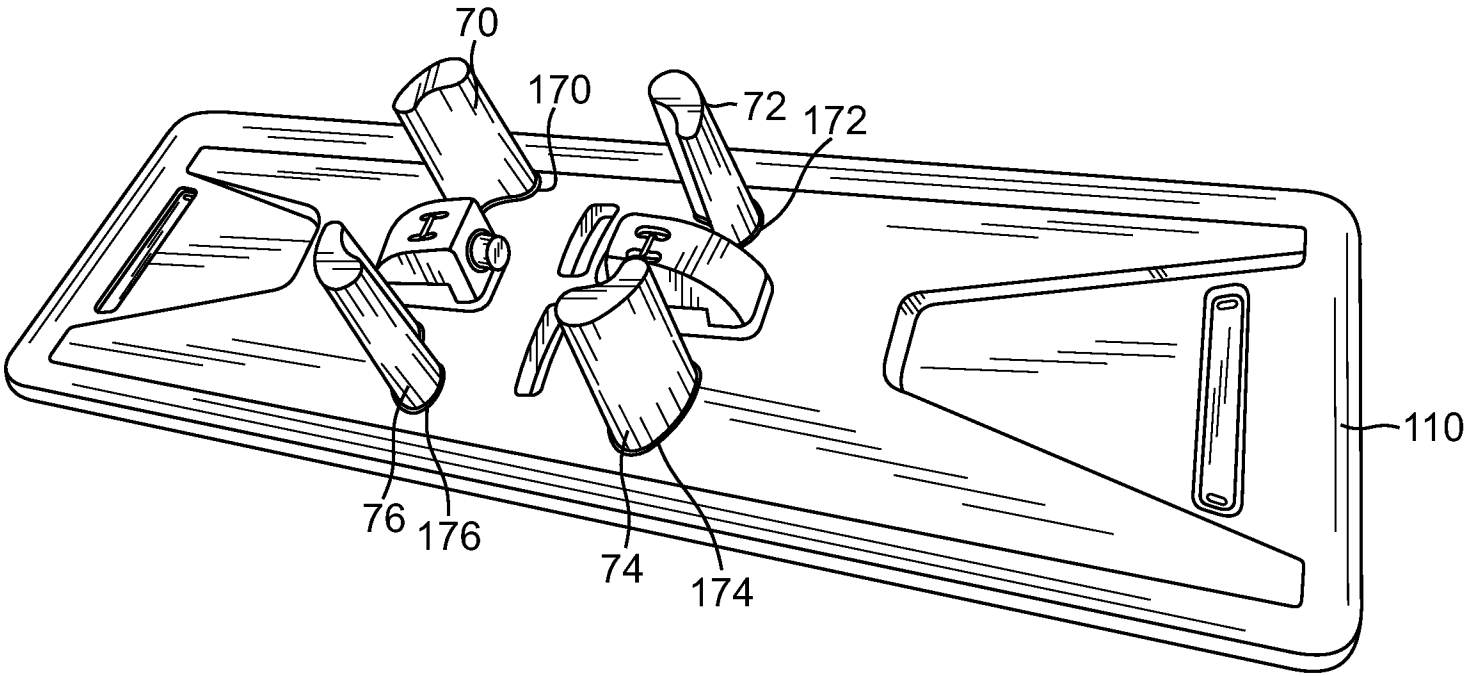
FIG. 8 is a top perspective view of the combined top plate and bottom plate movably positioned against each other.
Figure 9:
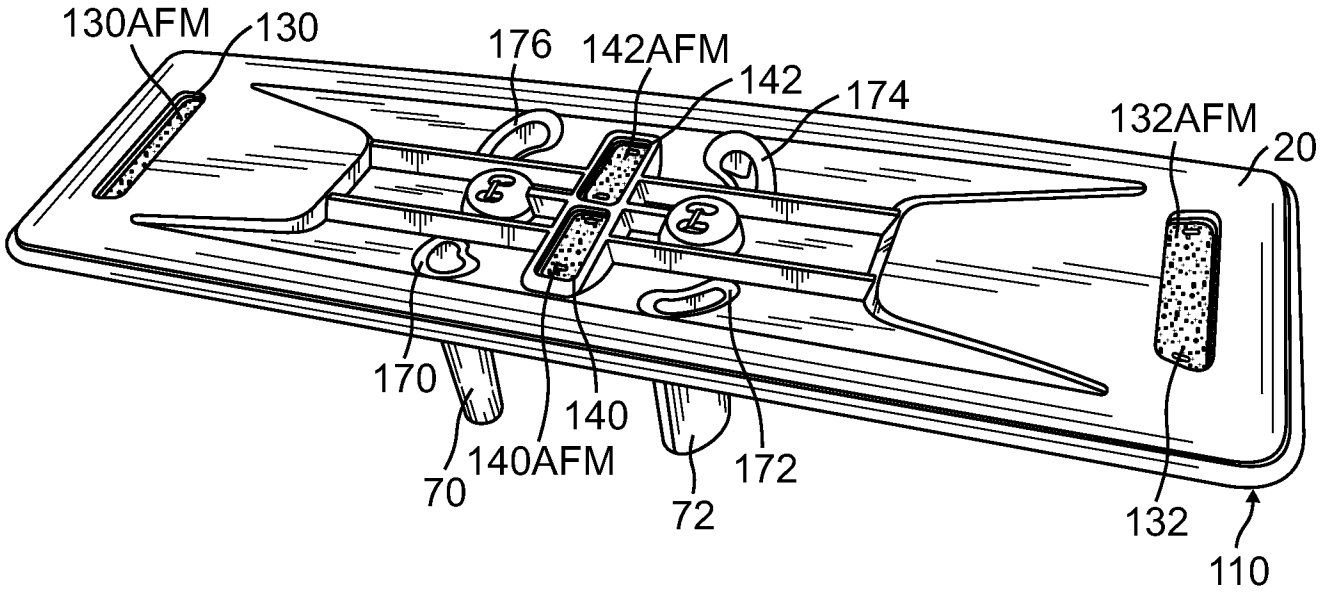
FIG. 9 is a bottom perspective view of the combined top plate and bottom plate movably positioned against each other.

Referring to FIG. 7, there is illustrated an exploded view on how top plate 110 is aligned with bottom plate 20. A first retaining force spring 60 is fastened at one end 61 to first spring retaining member 52 of bottom plate 10 and affixed at its opposite end 62 to spring retaining member 151 of first yoke retaining member 150 of top plate 110. A second retaining force spring 64 is fastened at one end 65 to second spring retaining member 56 of bottom plate 10 and affixed at its opposite end 66 to spring retaining member 153 of second yoke retaining member 152. The four posts 70, 72, 74 and 76 on bottom plate 10 are respectively aligned with the four openings 170, 172, 174 and 176 of top plate 110 and when top plate 110 and bottom plate 10 are pressed and retained together by first retaining force spring 60 and second retaining force spring 64, a respective post 170, 172, 174 and 176 extends through respective opening 70, 72, 74 and 76 as illustrated in FIGS. 8 and 9. First transverse affixation member 130 with affixation member 130AFM of top plate 110 are aligned with and extend through first transverse opening 30 in bottom plate 10. Second transverse affixation member 132 and affixation member 132AFM are aligned with and extend through second transverse opening 32 in bottom plate 10. First central transverse affixation member 140 and first central affixation member 140AFM of top plate 110 extends through first center transverse opening 40 in bottom plate 10. Second central transverse affixation member 142 and second central affixation member 142AFM of top plate 110 extend through second center transverse opening 42 in bottom plate 10.

A cleaning cloth such as a microfiber cloth or woven cloth 300 is retained against the bottom surface 80 of bottom plate 10 by the affixation members 130AFM, 132AFM. 140AFM, and 142AFM by the hook fasteners. A force must overcome the retaining force of retaining force springs 60 and 62, which separate force causes the bottom plate 10 to move away from the top plate 110 and thereby cause the microfiber cloth 300 to be pushed away from the affixation members 130AFM, 132AFM, 140AFM and 142AFM so that the microfiber cloth 300 falls away from the bottom surface 80 of bottom plate 10 so it can be discarded.

Figure 1:
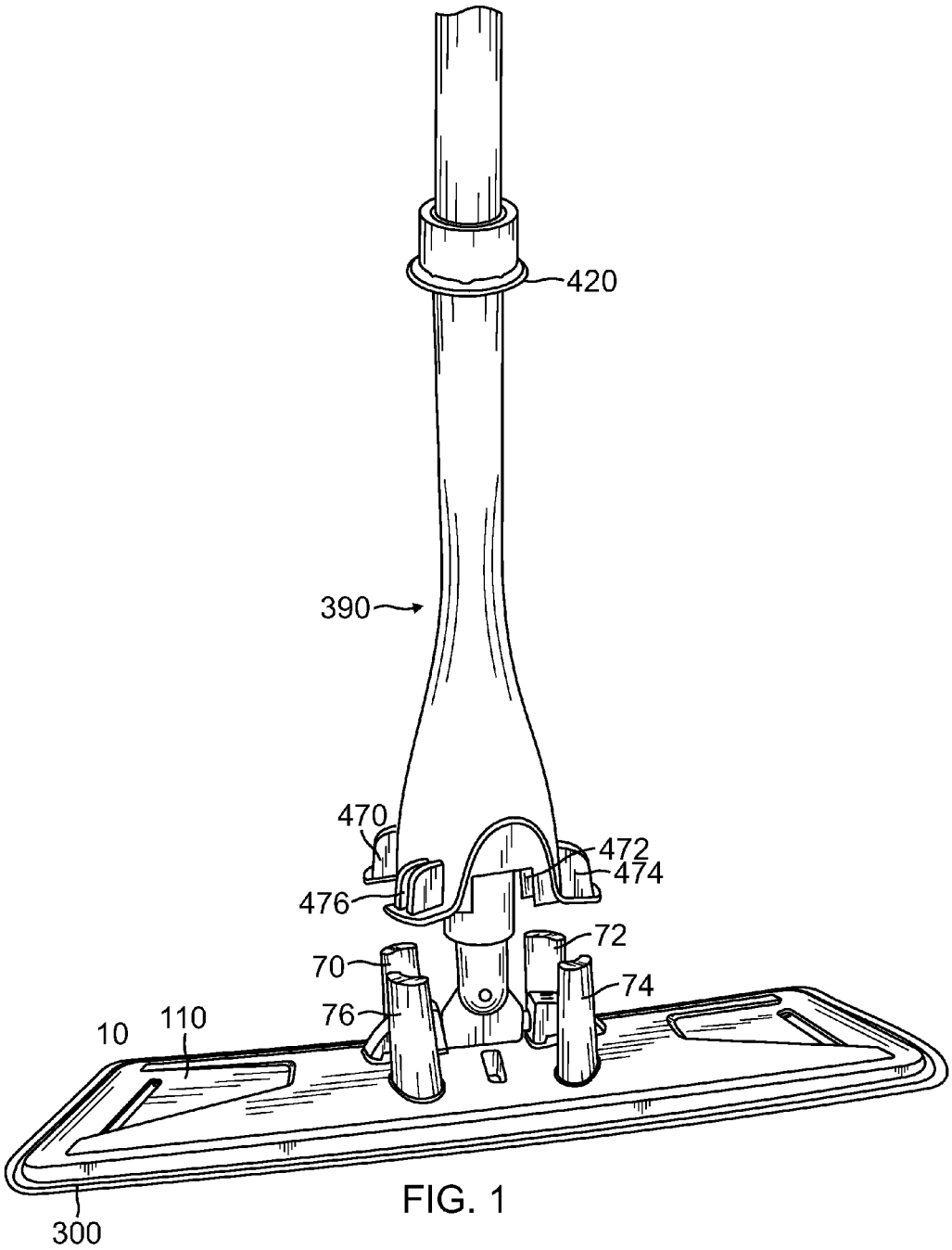
FIG. 1 is a side perspective view of the present invention hand operated sweeping mop with shotgun mechanism in place so that the top and bottom plates are pressed together to retain a cleaning cloth.
Figure 1A:
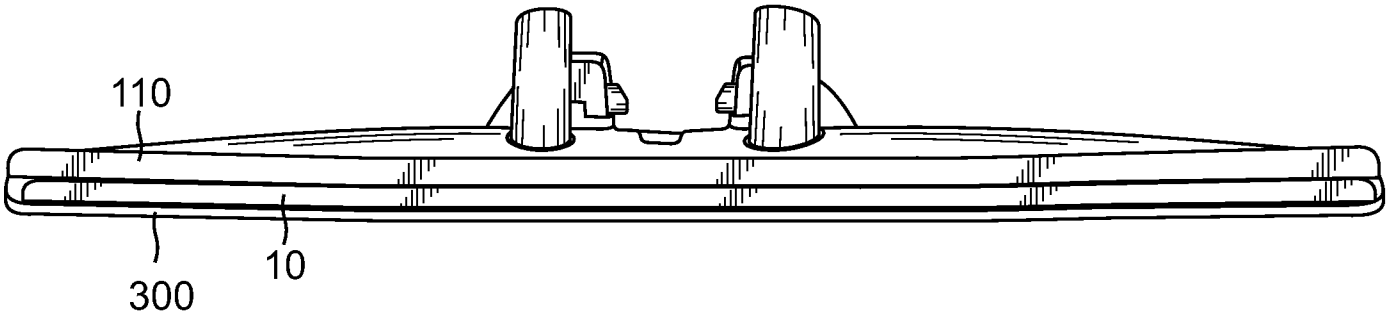
FIG. 1A is a bottom perspective view of the top and bottom plates with cloth retaining members on the underside of the top plate which extend through respective openings in the bottom plated to retain a cloth against a bottom of the bottom plate which is the condition of the two plates illustrated in FIG. 1.
Figure 2:
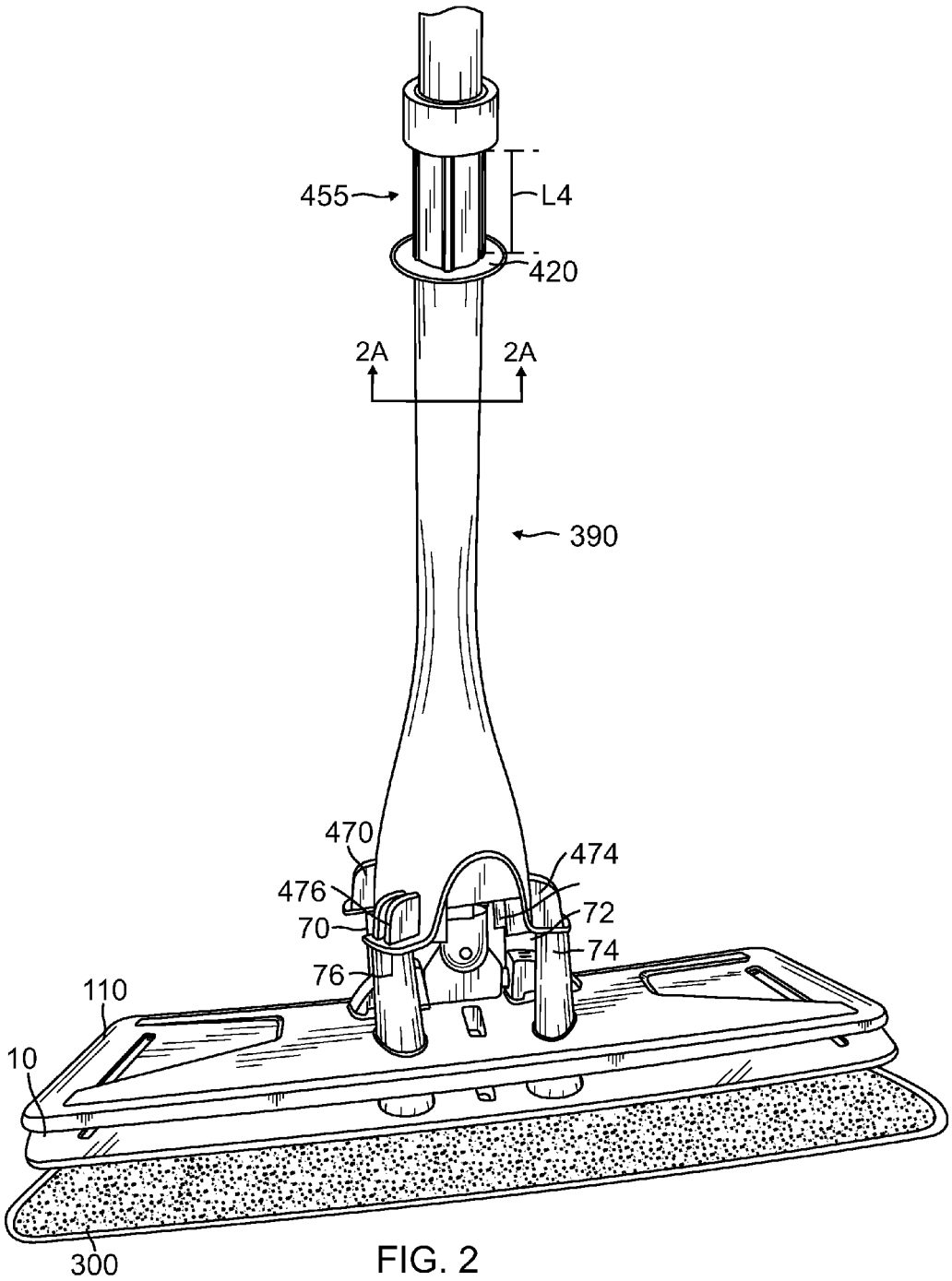
FIG. 2 is a side perspective view of the present illustrating the shotgun release mechanism in its fully activated condition so that the top plate and bottom plate are separated to cause the cloth retaining member to be released from the cloth so that the cleaning cloth falls away from the bottom plate.

The unique shotgun mechanism which permits top plate 110 and bottom plate 10 to be retained together as illustrated in FIG. 1 so that the microfiber cloth is retained against the bottom surface 80 of bottom plate 20 as previously described and also facilitates a downward pushing force to overcome the spring retaining force of the force springs 60 and 62 which downward force on the bottom plate 10 causes separation of the bottom plate 10 from the top plate 110 to cause the separation of the retaining hook members from the microfiber cloth as previously described and illustrated in FIG. 2.

It will be appreciated that the above embodiment of two plates with cloth retaining members on one plate extending through a second plate where the plates are retained together by a mechanism to overcome a retaining force from retaining force members such a the springs can be created with different embodiments and the apparatus described above is only one preferred embodiment to cause a separation of the cloth retaining members from the cloth so that the cloth can be discarded without hands touching the dirty cloth.

Figure 10A:
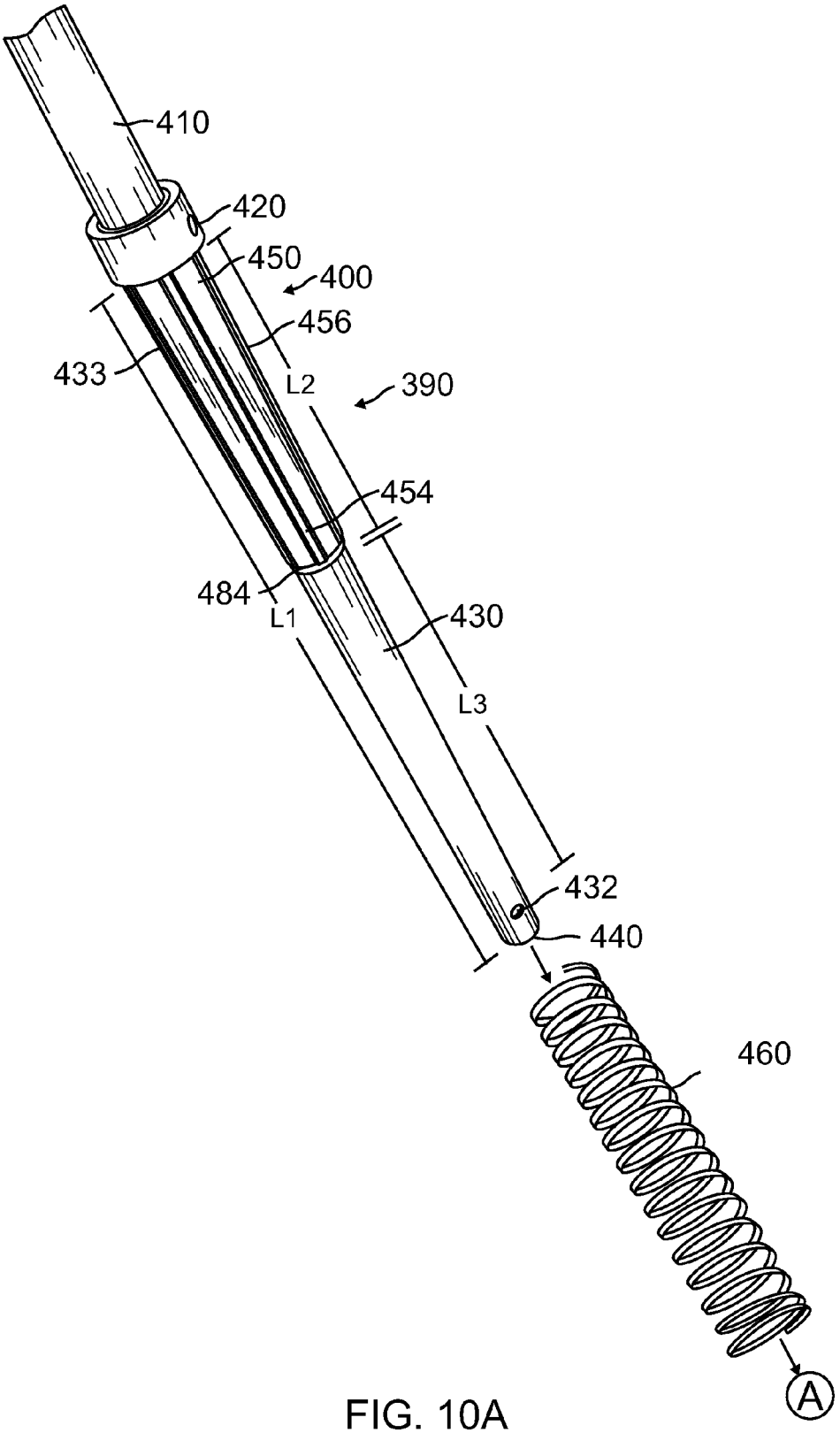
FIG. 10A is a perspective exploded view of an upper portion of the shotgun handle of the present invention illustrating anti-rotation ribs on the handle and extending from a stop member to a widened portion of the handle and narrow portion of the handle around which a retaining force spring is positioned.

The unique shotgun retaining and separating mechanism called a shotgun 390 built into the mop handle will now be described. Referring to FIG. 10A, as a first or upper portion of the shotgun 390, a section of as mop handle 400 is illustrated. The mop handle has an upper section 410 which is elongated so that it can be grasped by a cleaning person's hands. A circular stopping ring 420 surrounds a lower portion of the upper section 410 of the mop handle 400. The mop handle 400 includes an elongated cylindrical metal shaft 430 having a total length of "L1" extending from the stopping collar 420 to its proximal end 440. The elongated cylindrical metal shaft 430 has a transverse opening 432 extending through the elongated cylindrical metal shaft 430 at a location adjacent the proximal end 440 of the elongated cylindrical metal shaft 430. An elongated cylindrical covering member 450 surrounds a portion of the elongated cylindrical metal shaft for a given length "L2" extending from the stopping ring 420 to approximately a mid-length of the elongated cylindrical metal shaft 430. The cylindrical covering member 450 has a multiplicity of spaced apart exterior elongated ribs running the entire length "L2" of the cylindrical covering member 450. By way of example, there can be four ribs 452, 454, 456 and 458 (See FIG. 2A). A retaining compression spring 460 surrounds a portion of the remaining length "L3" of the elongated cylindrical medal shaft from the lower proximal end 451 of the cylindrical covering member 450 to above the transverse opening 432 adjacent the proximal end 440 of the elongated cylindrical metal shaft 430 so that transverse opening 432 remains exposed.

Figure 2A:
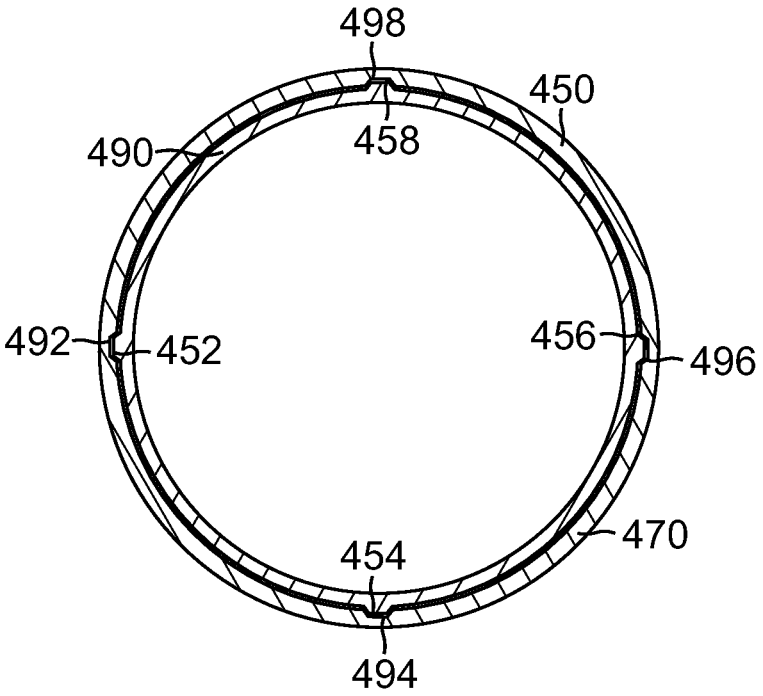
FIG. 2A is a cross-sectional view taken along line 2A-2A of FIG. 2 looking into the interior of the shotgun handle.
Figure 10B:
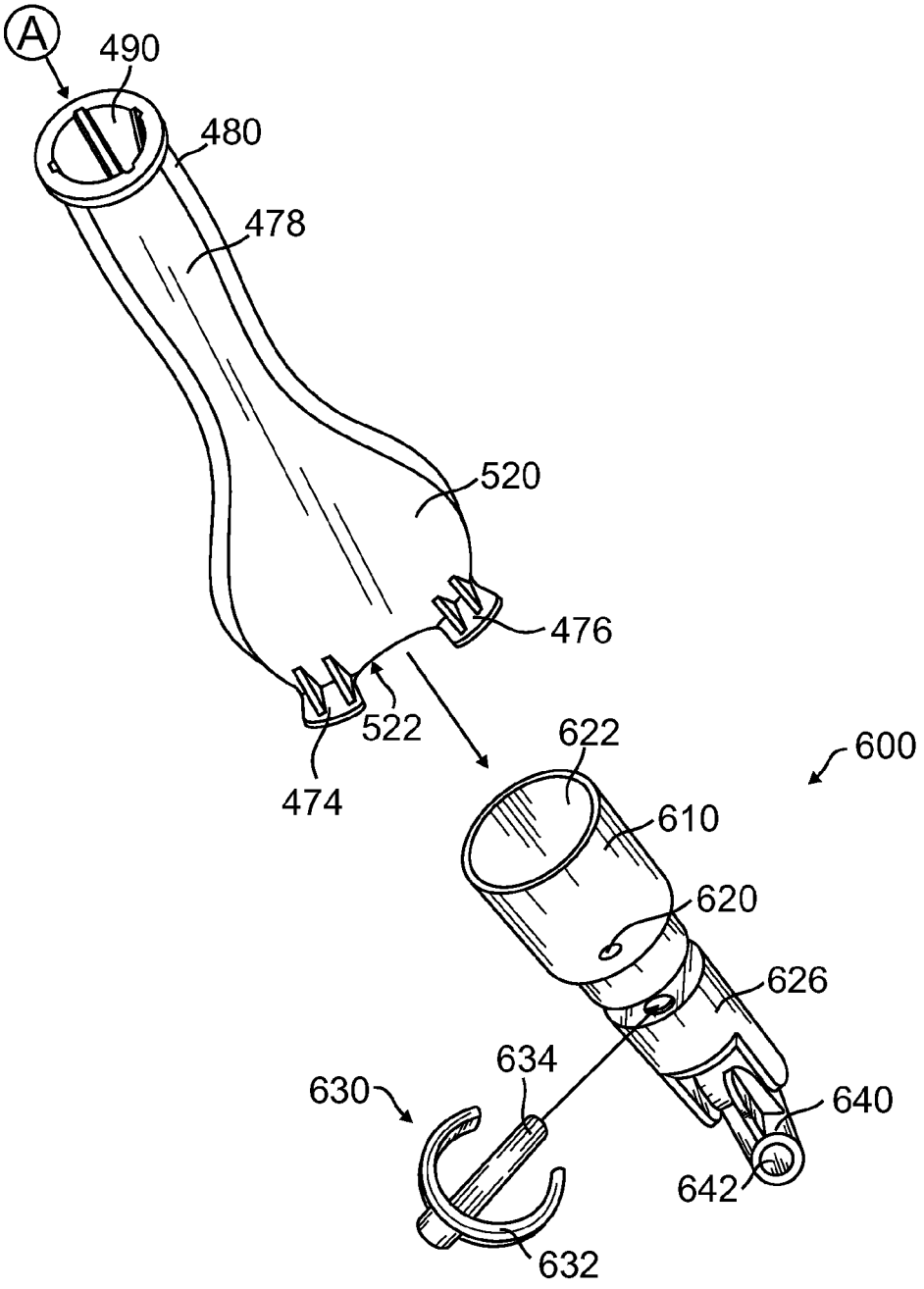
FIG. 10B is a continuation of the perspective exploded view of the shotgun handle of the present invention from FIG. 10A, further illustrating a lower housing of the shotgun handle with post engaging feet positioned at the bottom of the lower housing and a handle engaging member with a retaining C-clip to retain the elongated cylindrical shaft of a mop handle to a collar of the handle engaging member with the engaging member also affixed to a joining member having a rotation joining section which is rotatably affixed to the top plate and enables the mop handle to be rotated in all directions when the joining member is rotatably held in place by a handle receiving section on the top plate.

Referring to FIG. 10B and FIG. 2A, the lower portion of the shotgun has a housing member 470 having an upper cylindrical section 480 extending for a portion of the length "L2" of the cylindrical covering member with a gap 455 having a length "L4" (See FIG. 1) and having an interior surface 490 having a multiplicity of spaced apart receiving shafts respectively aligned with to receive a respective one of the multiplicity of ribs from the cylindrical covering member 450. As best illustrated in FIG. 2A, the interior surface 490 has four elongated spaced apart shafts 492, 494, 496 and 498 which run the interior length of the upper cylindrical section 480 and respectively receive ribs 452, 454, 456 and 458 when the housing member 470 is placed over and around the cylindrical metal shaft 430 and the cylindrical covering member 450. The upper surface 500 of upper cylindrical section 480 has a ring 510. In action, the outer housing through a pulling force from the retaining compression spring 460 forces upper cylindrical section 480 to move along gap 455 until it is stopped by the stop ring 420. The mating ribs 452, 454, 456 and 458 with shafts 492, 494, 496 and 498 prevents rotation of the housing member 470.

The housing member 470 has a widened lower section 520 with four feet 430, 432, 434 and 436 with openings 431, 433, 435 and 437 to respectively receive a post 70, 72, 74 and 76. When the entire housing member 470 is placed over the cylindrical metal shaft 430 and the cylindrical covering member 450 and comes in contact with the ribs as illustrated in FIG. 2, the four feet are separated from the four posts 70, 72, 74 and 76.

Referring again to FIG. 10B, the yoke engaging assembly 600 includes an upper collar 610 having a transverse opening 620. The upper collar 620 is inserted into an interior 522 of widened lower section 520 and surrounds the lower section of the cylindrical metal shaft 430 so the transverse opening 620 in the upper collar 610 and the transverse opening 432 in the cylindrical metal shaft are aligned and retained in place by a C-clip 630 having a partial circular section 632 and a shaft 634. The shaft 634 is inserted through aligned openings 620 and 432 and the partial circular section 634 surrounds the exterior of elongated cylindrical metal shaft 430. The yoke engaging assembly 600 is thereby retained onto the elongated cylindrical metal shaft 430 so that the retaining compression spring 460 is compressed between the proximal end 451 of covering member 450 and the upper rim 622 of upper collar 620. Upper collar 620 extends to an H member which is rotatably connected to a cylindrical section 640 having an interior opening 642 which is rotatably retained between and by dowel members 150D and 152D of yoke retaining members 150 and 152.

When the shotgun 390 is in place as illustrated in FIG. 1, the retention force of retaining force springs 60 and 64 prevails because the shotgun member 390 is moved by retaining compression spring 460 so that upper cylindrical section 480 is against the stop ring 420 and feet 70, 72, 74 and 76 are separated from posts 470, 472, 474 and 476. In its at rest condition, the pulling force of retention force spring 460 is exerted on housing 470 which is pulled upwardly around a portion of cylindrical covering member 450 and a portion of elongated metal shaft 430 until it reaches the stop ring 420 as illustrated in FIG. 1, the feet 470, 472, 474 and 476 of the housing 470 are removed from the posts 70, 72, 74 and 76 thereby releasing exerted no force on the bottom plate 110 so that retaining force spring 60 and 62 forces bottom plate 10 to rest against the top plate 110 to retain the cloth 300 as previously described. When the downward pushing force is exerted on housing 470 to overcome the force of retention force spring 460, the pushing force forces housing 470 into place so that feet 470, 472, 474 and 476 are engaged onto posts 70, 72, 74 and 76 and bottom plate 10 is pushed away from the top plate 110 to separate the cloth from the retention members extending from the bottom of top plate 110 through respective opening in the bottom plate 10 to enable the cloth 30 to be released. When the downward pushing force is released, the retention force spring causes the housing 470 to move axially away from the top plate 110 and bottom plate 10 until the housing 470 is stopped against the stop ring 420, resembling the action of a shotgun.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hand operated sweeping mop applicator, comprising:

a. a bottom plate having a given shape including at least a first lengthwise sidewall, a parallel oppositely disposed second lengthwise sidewall, a first transverse wall and an oppositely disposed second transverse wall, the bottom plate having a given thickness from a top surface of the bottom plate to a bottom surface of the bottom plate, the bottom plate including a first transverse opening adjacent to the first transverse wall and extending through the given thickness from the top surface of the bottom surface, a second transverse opening parallel to the first transverse opening, the second transverse opening adjacent to the second transverse wall and extending through the given thickness from the top surface to the bottom surface, a first center transverse opening extending from adjacent the first lengthwise sidewall to adjacent a center point of the bottom plate and extending through the given thickness from the top surface to the bottom surface, an aligned second center transverse opening extending from adjacent the second lengthwise sidewall to adjacent the center point of the bottom plate and extending through the given thickness from the top surface to the bottom surface, a center wall separating the first center transverse opening from the second center transverse opening and extending through the given thickness from the top surface to the bottom surface, a first offset opening extending from adjacent a first side of the first and second center transverse openings and from the top surface to partially into the given thickness, a first spring retaining member extends from an aligned location in the bottom plate from the bottom surface into the first offset opening and having a pair of openings separated by a center wall to retain an end of a first spring, a second offset opening extending from adjacent a second side of the first and second center transverse openings from the top surface and partially into the given thickness, a second spring retaining member extending from an aligned location in the bottom plate from the bottom surface into the second offset opening and having a pair of openings separated by a center wall to retain an end of a second spring, four spaced apart posts are positioned 90 degrees apart in a circular configuration with two spaced apart posts adjacent the first lengthwise sidewall respectively to the left of the first offset opening and to the right of the second offset opening, and two spaced apart posts are adjacent the second lengthwise sidewall and are respectively to the right of the second offset opening and to the left of the first offset opening, each post extending perpendicularly to the top surface for a given height respectively embedded into the bottom plate and extending through the bottom plate given thickness from the top surface to the bottom surface;

b. a top plate approximately the same size as the bottom plate, the top plate having a first lengthwise sidewall, a parallel oppositely disposed second lengthwise sidewall, a first transverse wall and an oppositely disposed second transverse wall, the top plate having a given thickness from its top surface to its bottom surface, a first transverse affixation member adjacent the first transverse wall and extending for a distance perpendicular to the bottom surface and terminating in a bottom affixation surface which retains a first affixation member, a second transverse affixation member is adjacent to the second transverse wall and extending for a distance perpendicular to the bottom surface and terminating in a bottom affixation surface which retains a second affixation member, a first yoke retaining member positioned on the top surface to one side of the location where the first and second transverse affixation members are located on the bottom surface, the first yoke retaining member affixed to and extending perpendicular to the top surface and supporting an interior dowel which extends toward the center point of the top plate, a second yoke retaining member positioned on the top surface at an opposite side of the location where the first and second transverse affixation members are located on the bottom surface, the second yoke retaining member is affixed to and extending perpendicular to the top surface and supports an interior dowel member, the first and second yoke members are parallel and aligned with each other and are affixed to the top surface with the respective dowels aligned with each other, a first transverse affixation member extending from adjacent the first lengthwise sidewall to adjacent to a center point of the top plate and extending perpendicular to the bottom surface by a given distance and terminates in a bottom affixation surface which retains an affixation member, an aligned second transverse affixation member extending from adjacent the second lengthwise sidewall to adjacent to the center point of the top plate and extending perpendicular to the bottom surface by a given distance, and terminates in a bottom affixation surface which retains an affixation member which preferably is a hook member of a hook and loop fastener, the first and second transverse affixation members are spaced apart by a given distance, four openings are positioned 90 degrees apart in a circular configuration, two spaced apart openings are adjacent the first lengthwise sidewall and two spaced apart openings are adjacent the second lengthwise sidewall, the openings extend through the given thickness of the top plate and extending from the top surface to the bottom surface, respective spaced apart openings in the top plate match a shape of the posts in the bottom plate;

c. a first retaining force spring is fastened at one end to the first spring retaining member of the bottom plate and affixed at its opposite end to the spring retaining member of the first yoke retaining member of the top plate, a second retaining force spring is fastened at one end to the second spring retaining member of the bottom plate and affixed at its opposite end to a spring retaining member of the second yoke retaining member, the four posts on the bottom plate are respectively aligned with the four openings of the top plate and when the top plate and bottom plate are pressed together by action of the first retaining force spring and second retaining force spring, a respective post extends through a respective opening, the first transverse affixation member with the first affixation member of the top plate are aligned with and extend through the first transverse opening in the bottom plate, the second transverse affixation member and second affixation member are aligned with and extend through the second transverse opening in the bottom plate, the first central transverse affixation member and first center affixation member of the top plate extend through the first center transverse opening in the bottom plate, the second central transverse affixation member and the second center affixation member of the top plate extend through the second center transverse opening in the bottom plate;

d. a cleaning cloth is retained against the bottom surface of the bottom plate by the two first and two second affixation members and by the two central affixation members by respective fasteners, so that when the top plate and bottom plate are retained together by the retaining force springs, the cloth is retained, and when a pushing force overcomes the retaining force of the retaining force springs, the bottom plate is caused to move away from the top plate and thereby cause the cloth to be pushed away from the first and second affixation members and first and second central affixation members so that the cloth falls away from the bottom surface of the bottom plate so it can be discarded;

e. a shotgun mechanism permits the top plate and the bottom plate to be retained together so that the cloth is retained against the bottom surface of the bottom plate, and a downward pushing force on the shotgun mechanism overcomes and forces a separation of the bottom plate from the top plate to cause the separation of each affixation member from the cloth;

f. the shotgun mechanism is built into the mop handle, an upper portion of the shotgun mechanism includes an upper section which is elongated so that it can be grasped, a stopping ring which surrounds a lower portion of the upper section of the mop handle, the mop handle includes an elongated shaft having a given length extending from the stopping ring to its proximal end, the elongated shaft has a transverse opening extending through the elongated shaft at a location adjacent the proximal end of the elongated shaft, an elongated covering member surrounds a portion of the elongated shaft for a given length extending from the stopping ring to approximately a midi-length length of the elongated shaft, the covering member has a multiplicity of spaced apart exterior elongated ribs running the entire length of the covering member, a retention compression spring surrounds a portion of the remaining length of the elongated shaft from the lower proximal end of the covering member to above the transverse opening adjacent the proximal end of the elongated shaft so that the transverse opening remains exposed, the lower portion of the shotgun mechanism has a housing member having an upper section extending for a portion of the length of the covering member with a gap between an upper surface of the section and the stopping ring to exposing a portion of the multiplicity of ribs on the covering member, the section having a given length and having an interior surface having a multiplicity of spaced apart receiving shafts respectively aligned with to receive a respective one of the multiplicity of ribs from the covering member when the housing member is placed over and around the shaft and the covering member, the upper surface of upper section has a ring, in action, the outer housing through a pulling force from the retention compression spring moves along the gap until it is stopped by the stopping ring, the mating ribs with the shafts prevents rotation of the housing member, the housing member has a widened lower section with four feet with openings to respectively receive a post when the entire housing member is placed over the cylindrical metal shaft and the cylindrical covering member with the pulling force separating the four feet from the four posts, a yoke engaging assembly includes an upper collar having a transverse opening, the upper collar is inserted into an interior of the widened lower section and surrounds a lower section of the metal shaft so the transverse opening in the upper collar and the transverse opening in the metal shaft are aligned and retained in place by a clip having a partial exterior section and a shaft, the shaft is inserted through the aligned openings and the partial section surrounds an exterior of the elongated metal shaft, the yoke engaging assembly is thereby retained onto the elongated metal shaft so that the retention compression spring is compressed between the proximal end of the covering member and the upper rim of upper collar, the upper collar extends to a member which is rotatably connected to a section having an interior opening which is rotatably retained between and by dowel members of the yoke retaining members; and g. when the shotgun is activated, a downward pushing force on the shotgun housing overcomes the retaining force of the retention force spring and causes a respective foot from the shotgun housing to respectively retain a post and pushing down on the posts, causes a separation of the bottom plate from the top plate so that the engagement of the cloth affixation members is released and the cloth falls away, and when the downward force is released, the springs between the top plate and the bottom plate cause the two plates to be retained together when the housing member is pulled upwardly around a portion of the covering member and a portion of the elongated shaft until it reaches the stopping ring and the feet of the housing are removed from the posts thereby releasing the top plate so that force springs between the top plate and the bottom plate force the bottom plate to rest against the top cloth, and when the pushing force on the housing is released, the spring within the shotgun mechanism forces the housing back into place so that feet are respectively disengaged onto respective posts and the bottom plate is once again retained against the top plate to facilitate retention of another cloth, the upward pulling force on the housing from the retaining compression spring forces a return of the housing against the stopping ring having the effect of a shotgun.

2. A hand operated sweeping mop applicator, comprising:

a. a bottom plate including at least a first lengthwise sidewall, a parallel oppositely disposed second lengthwise sidewall, a first transverse wall and an oppositely disposed second transverse wall, the bottom plate having a given thickness from a top surface of the bottom plate to a bottom surface of the bottom plate, the bottom plate including a first transverse opening adjacent to the first transverse wall and extending through the given thickness from the top surface of the bottom surface, a second transverse opening parallel to the first transverse opening, the second transverse opening adjacent to the second transverse wall and extending through the given thickness from the top surface to the bottom surface, a first offset opening extending to one side of a center location of the bottom plate and extending from the top surface to partially into the given thickness of the bottom plate, a first spring retaining member extending from an aligned location in the bottom plate from the bottom surface into the first offset opening and having a pair of openings separated by a center wall to retain an end of the first spring, a second offset spring opening extending from adjacent the center position of the bottom plate at a location opposite to the first transverse opening, the second transverse opening extending from the top surface and partially into the given thickness, a second spring retaining member extending from an aligned location in the bottom plate from the bottom surface into the second offset opening and having a pair of openings separated by a center wall to retain an end of a second spring, a multiplicity of spaced apart mating members which are offset with a portion of the multiplicity of mating members to the left of the first offset opening and a portion of the multiplicity of mating members to the right of the second offset opening, each mating member extending perpendicularly to the top surface for a given height respectively embedded into the bottom plate and extending through the bottom plate at a given thickness from the top surface to the bottom surface;

b. a top plate approximately the same size as the bottom plate, the top plate having a first lengthwise sidewall, a parallel oppositely disposed second lengthwise sidewall, a first transverse wall and an oppositely disposed second transverse wall, the top plate having a given thickness from its top surface to its bottom surface, a first transverse affixation member adjacent the first transverse wall and extending for a distance perpendicular to the bottom surface and terminating in a bottom affixation surface which retains a first affixation member, a second transverse affixation member is adjacent to the second transverse wall and extending for a distance perpendicular to the bottom surface and terminating in a bottom affixation surface which retains a second affixation member, a yoke retaining member positioned on the top surface of the bottom plate, the yoke member is affixed to the top surface, a first transverse affixation member extending from adjacent the first lengthwise sidewall to adjacent to a center point of the top plate and extending perpendicular to the bottom surface by a given distance and terminating in a bottom affixation surface which retains an affixation member, an aligned second transverse affixation member extending from adjacent the second lengthwise sidewall to adjacent to the center point of the top plate and extending perpendicular to the bottom surface by a given distance, and terminating in a bottom affixation surface which retains an affixation member, the first and second transverse affixation members are spaced apart by a given distance, a multiplicity of openings are positioned apart in a configuration aligned with the mating members of the bottom plate, each of the multiplicity of openings extend through a given thickness of the top plate and extending from the top plate to the bottom surface, a respective spaced apart opening in the top plate matching a shape of a mating surface in the bottom plate;

c. a first retaining force spring is fastened at one end to a first spring retaining member of the bottom plate and affixed at its opposite end to a spring retaining member of the yoke retaining member of the top plate, a second retaining force spring is fastened at one end to a second spring retaining member of the bottom plate and affixed at its opposite end to a spring retaining member of the yoke retaining member, a multiplicity of retaining members on the bottom plate are respectively aligned with a multiplicity of openings of the top plate and when the top plate and bottom plate are pressed together by action of the first retaining force spring and second retaining force spring, a respective retaining member extends through a respective opening, the first affixation member with the first affixation member of the top plate are aligned with and extend through the first transverse opening in the bottom plate, the second transverse affixation member and second affixation member are aligned with and extend through the second transverse opening in the bottom plate;

d. a cleaning cloth is retained against the bottom surface of the bottom plate by the first affixation member and the second affixation member, so that when the top and bottom plate are retained together by the retaining force springs, the cloth is retained, and when a pushing force overcomes the retaining force of the retaining force springs, the bottom plate is caused to move away from the top plate and thereby cause the cloth to be pushed away from the first and second affixation members and so that the cloth falls away from the bottom surface of bottom plate so it can be discarded;

e. a shotgun mechanism permits the top plate and the bottom plate to be retained together so that the cloth is retained against the bottom surface of bottom plate, and a downward pushing force on the shotgun mechanism overcomes and forces a separation of the bottom plate from the top plate to cause the separation of each retaining member from the cloth;

f. the shotgun mechanism is built into the mop handle, an upper portion of the shotgun includes an upper section which is elongated so that it can be grasped, a stopping ring which surrounds a lower portion of the upper section of the mop handle, the mop handle includes an elongated shaft having a given length extending from the stopping ring to its proximal end, the elongated shaft has a transverse opening extending through the elongated shaft at a location adjacent the proximal end of the elongated shaft, a covering member surrounds a portion of the elongated shaft for a given length extending from the stopping ring to approximately a mid-length of the elongated shaft, the covering member has a multiplicity of spaced apart exterior elongated ribs running the entire length of the covering member, a retention compression spring surrounds a portion of the remaining length of the elongated shaft from the lower proximal end of the covering member to above the transverse opening adjacent the proximal end of the elongated shaft so that the transverse opening remains exposed, the lower portion of the shotgun mechanism has a housing member having an upper section extending for a portion of the length of the covering member with a gap between an upper surface of the section and the stopping ring to exposing a portion of the multiplicity of ribs on the covering member, the section having a given length and having an interior surface having a multiplicity of spaced apart receiving shafts respectively aligned with to receive a respective one of the multiplicity of ribs from the covering member when the housing member is placed over and around the shaft and the covering member, the upper surface of the upper section has a ring, in action, the outer housing through a pulling force from the retention compression spring moves along a gap until it is stopped by the stopping ring, the mating ribs with the shafts prevents rotation of the housing member, the housing member has a widened lower section with openings to respectively receive mating members from the top plate when the entire housing member is placed over the shaft and the covering member with the pulling force separating the mating members, a yoke engaging assembly includes an upper collar having a transverse opening, the upper collar is inserted into an interior of the widened lower section and surrounds a lower section of the shaft so the transverse opening in the upper collar and the transverse opening in the shaft are aligned and retained in place by a clip having a partial exterior section and a shaft is inserted through the aligned openings and the partial exterior section surrounds an exterior of the elongated shaft, the yoke engaging assembly is thereby retained onto the elongated shaft so that the retention compression spring is compressed between the proximal end of the covering member and the upper rim of the upper collar, the upper collar extends to a member which is rotatably connected to a section having an interior opening which is rotatably retained by yoke retaining members; and g. when the shotgun is activated, a downward pushing force on the shotgun housing overcomes the retaining force of the retention force spring and causes a respective foot from the shotgun housing to respectively retain a mating member and pushing down on the mating members causes a separation of the bottom plate from the top plate so that the engagement of the cloth affixation members is released and the cloth falls away, and when the downward force is released, the springs between the top plate and the bottom plate cause the two plates to be retained together when the housing member is pulled upwardly around a portion of the covering member and a portion of the elongated shaft until it reaches the stop ring and the feet of the housing are removed from the mating members thereby releasing the top plate so that force springs between the top plate and the bottom plate forces the bottom plate to rest against the top cloth, and when the pushing force on the housing is released, the spring within the shotgun mechanism forces the housing back into place so that openings are respectively disengaged onto respective mating members and the bottom plate is once again retained against the top plate to facilitate retention of another cloth, the upward pulling force on the housing from the retaining compression spring forces a return of the housing against the stopping ring having the effect of a shotgun.

* * * * *